US007703451B2

(12) United States Patent
Bang

(10) Patent No.: US 7,703,451 B2
(45) Date of Patent: Apr. 27, 2010

(54) OVEN DOOR

(75) Inventor: Suck Jin Bang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/790,290

(22) Filed: Apr. 24, 2007

(65) Prior Publication Data

US 2007/0251520 A1 Nov. 1, 2007

(30) Foreign Application Priority Data

Apr. 24, 2006 (KR) ..... 10-2006-0036638
May 8, 2006 (KR) ..... 10-2006-0041051

(51) Int. Cl.
*F23M 7/00* (2006.01)

(52) U.S. Cl. ..... 126/190; 126/198; 126/200

(58) Field of Classification Search ..... 126/190, 126/198, 200; 16/110.1, 412, 436
See application file for complete search history.

(56) References Cited

U.S. PATENT DOCUMENTS 1,664,443 A * 4/1928 Williams et al. ..... 432/81
2,012,549 A * 8/1935 Rottersmann ..... 432/94
2,231,514 A * 2/1941 Verhagen ..... 52/209
2,961,694 A * 11/1960 May ..... 16/412
3,267,930 A * 8/1966 Casciani ..... 126/200
3,326,201 A * 6/1967 Murray ..... 126/25 R
3,818,890 A * 6/1974 Evans et al. ..... 126/200
3,855,994 A * 12/1974 Evans et al. ..... 126/198
3,859,499 A * 1/1975 Evans et al. ..... 219/396
3,991,738 A * 11/1976 Krebs ..... 126/200
4,023,554 A * 5/1977 Katona ..... 126/198
4,043,091 A * 8/1977 Katona ..... 52/786.1
4,060,069 A * 11/1977 Drouin ..... 126/200
4,206,338 A * 6/1980 Katona ..... 219/740
4,253,286 A * 3/1981 Katona ..... 52/171.1
4,313,418 A * 2/1982 Schrader et al. ..... 126/287
4,353,351 A * 10/1982 Cagle ..... 126/193

(Continued)

FOREIGN PATENT DOCUMENTS

EP 0 687 867 6/1995

(Continued)

OTHER PUBLICATIONS

Chinese Office Action dated Nov. 7, 2008.

*Primary Examiner*—Kenneth B Rinehart
*Assistant Examiner*—Jorge Pereiro
(74) *Attorney, Agent, or Firm*—Ked & Associates LLP

(57) ABSTRACT

An oven door includes upper fixtures, lower fixtures and middle frames which are attached to a front glass of the door. One or more panes of glass are mounted behind the front glass and are spaced from the front glass. As a result, air can circulate through a space behind the front glass. In addition, a door handle is coupled to the front glass using a through-hole formed in the front glass, spacers formed on the upper fixtures, and screws going through the spacer and the through-hole, and into the door handle. Outside air introduced from a bottom of the front glass goes out through a side of a space contacting the front glass and thus cools only the space contacting the front glass. Since the heavy division members are supported by only the lower fixture, the oven door can be easily assembled and disassembled when damaged.

41 Claims, 8 Drawing Sheets

U.S. PATENT DOCUMENTS

| | | | | | |
|---|---|---|---|---|---|
| 4,383,519 | A * | 5/1983 | Katona | 126/190 |
| 4,390,767 | A * | 6/1983 | Bucksbaum et al. | 219/740 |
| 4,613,530 | A * | 9/1986 | Hood et al. | 428/34 |
| 4,638,529 | A * | 1/1987 | Katona | 16/436 |
| 4,716,884 | A * | 1/1988 | Bonaccorsi et al. | 126/198 |
| 4,732,431 | A * | 3/1988 | Mason | 312/109 |
| 4,912,809 | A * | 4/1990 | Scheuer | 16/413 |
| 5,088,470 | A * | 2/1992 | James et al. | 126/41 R |
| 5,284,127 | A * | 2/1994 | Driesmans | 126/77 |
| 5,387,258 | A * | 2/1995 | Puricelli | 126/21 A |
| 5,615,918 | A * | 4/1997 | Ferrell | 292/92 |
| 5,819,722 | A * | 10/1998 | Katz | 126/200 |
| 6,463,628 | B1 * | 10/2002 | Yeh | 16/412 |
| 6,823,643 | B2 * | 11/2004 | France | 52/786.1 |
| 6,860,261 | B2 * | 3/2005 | Hines, Jr. | 126/20 |
| 6,904,904 | B2 * | 6/2005 | Walther et al. | 126/198 |
| D511,936 | S * | 11/2005 | Becker et al. | D7/406 |
| 6,959,480 | B2 * | 11/2005 | Wing et al. | 29/525.02 |
| 6,966,101 | B2 * | 11/2005 | Chiang | 16/412 |
| 7,043,886 | B1 * | 5/2006 | Chubb | 52/656.4 |
| 7,067,043 | B1 * | 6/2006 | Giertz et al. | 202/239 |
| 2003/0209018 | A1 * | 11/2003 | Becke et al. | 62/126 |
| 2004/0065311 | A1 * | 4/2004 | Hines, Jr. | 126/20 |
| 2004/0159317 | A1 * | 8/2004 | Walther et al. | 126/198 |
| 2005/0028805 | A1 * | 2/2005 | Bronstering et al. | 126/194 |
| 2005/0060844 | A1 * | 3/2005 | Chiang | 16/412 |
| 2005/0133019 | A1 * | 6/2005 | Kim et al. | 126/198 |

FOREIGN PATENT DOCUMENTS

| | | | |
|---|---|---|---|
| EP | 687867 | A1 * | 12/1995 |
| EP | 723116 | A2 * | 7/1996 |
| FR | 2 726 633 | | 5/1996 |

* cited by examiner

OVEN DOOR

BACKGROUND

1. Field

The present invention relates to an oven door, and more particularly, to an oven door that is easily assembled/disassembled and that provides selective insulation or selective cooling.

2. Background

Two common kinds of modern ovens are gas ovens and electric ovens. An electric oven heats food using heat generated by various heaters operated by electricity. Electric ovens may also make use of an apparatus that generates high frequency electromagnetic waves. Examples of heaters include ceramic heaters, sheath heaters, and halogen heaters. The electric ovens simultaneously heat the inside and the periphery of food to speed the cooking of the food and increase heat efficiency. In addition, the electric ovens are safe. Therefore, the electric ovens are widely used.

The electric oven typically has a cubical shape, with a cavity in which food is cooked. A front opening of the oven cavity is covered by a movable oven door. Typically, the door is hinged so that it can rotate to open the cavity. A handle is usually formed at an upper portion of the oven door.

A portion of an oven door may be formed of a transparent material to allow a user to look into the cavity. The oven door must provide good insulation so that heat is contained inside the cavity. Also, the door must not allow any external parts that can be touched by a user get too hot.

In addition, the oven door is required to be easily assembled and disassembled for repairs. However, because the door requires a hinge mechanism, and because it must by transparent, most oven doors are difficult to assemble/disassemble, and their insulation characteristics may be less than desirable.

BRIEF DESCRIPTION OF THE DRAWINGS

The embodiments will be described in detail with reference to the following drawings in which like reference numerals refer to like elements, and wherein.

DETAILED DESCRIPTION

Figure 1:
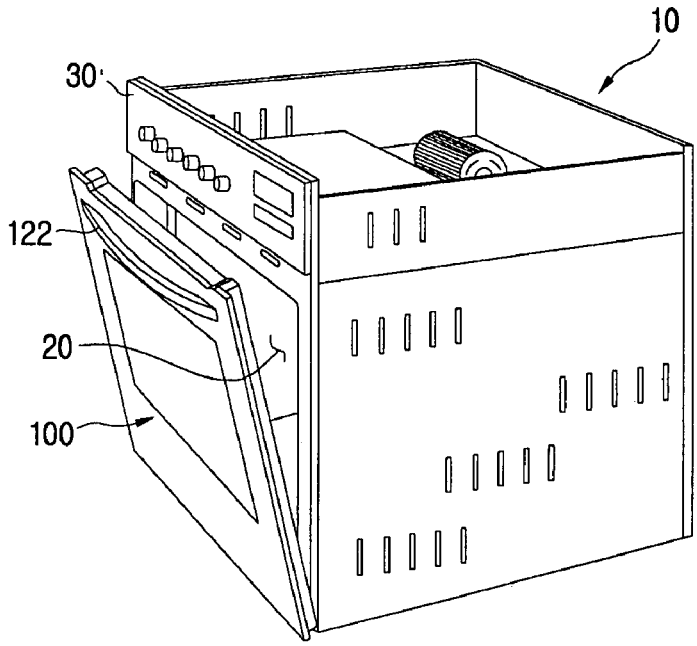
FIG. 1 is an perspective view illustrating an oven.

FIG. 1 is a perspective view illustrating a first embodiment of an oven. Referring to FIG. 1, the oven includes an inner heater 20, a main body 10, and an oven door 100. The main body 10 includes a control panel 30. The oven door 100 includes a transparent window so as to check the state of a food in the main body 10. The oven door 100 is coupled to the main body 10 by a hinge. A door handle 122 is formed in an upper portion of a front surface of the oven door 100.

Figure 2:
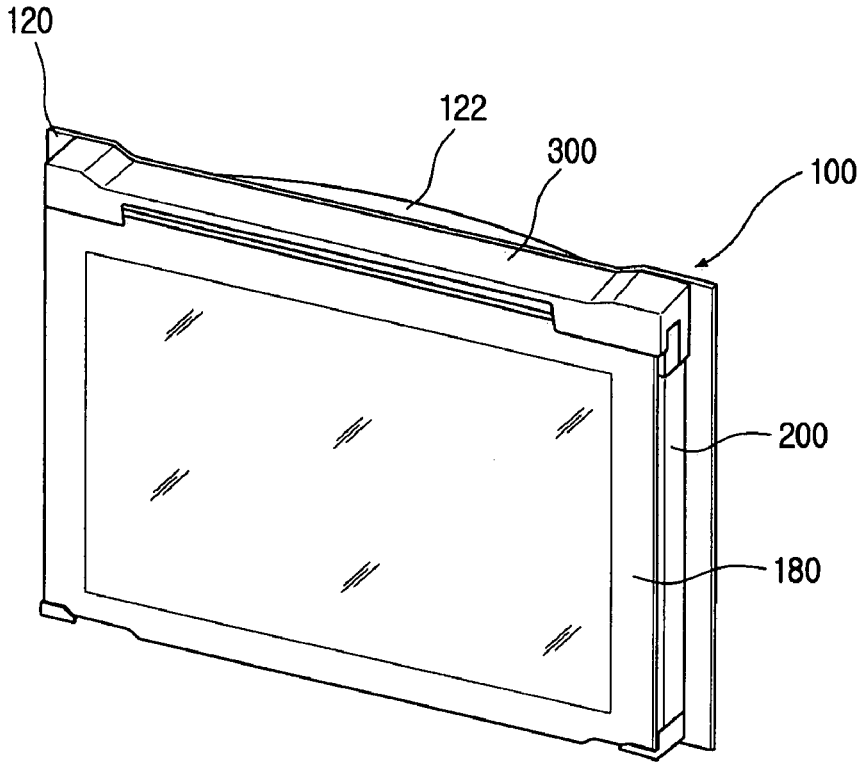
FIG. 2 is a perspective view illustrating an oven door.

FIG. 2 is a perspective view illustrating the oven door 100 in greater detail. Referring to FIG. 2, the oven door 100 includes a front glass 120, a top cover 300, door frames 200, and a rear glass 180. The front glass 120 provides the front appearance of the door. The top cover 300 is formed on an upper portion of a rear surface of the front glass 120 and provides a top appearance of the oven door 100. The door frame 200 is formed on both sides of the front glass 120, it supports the front glass 120, and it provides a side appearance of the oven door 100. The rear glass 180 is fixed by the door frame 200 and the top cover 300 and it provides a rear appearance of the oven door 100.

In this embodiment, the front glass 120 has a tetragonal shape and it is forms the front-most portion of the oven door 100. Because the front glass 120 provides the main appearance of an oven, the front glass 120 is coated to improve its appearance and to help prevent damage such as scratches.

Figure 3:
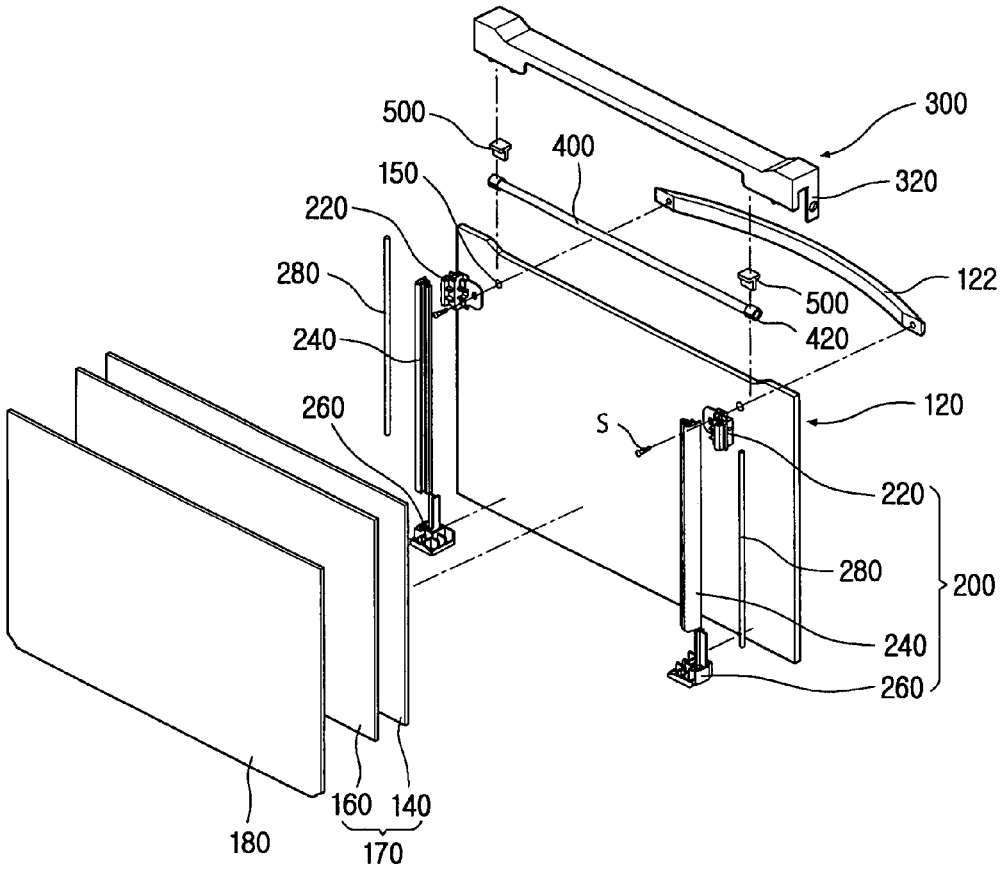
FIG. 3 is an exploded perspective view illustrating a first embodiment of an oven door.
Figure 4:
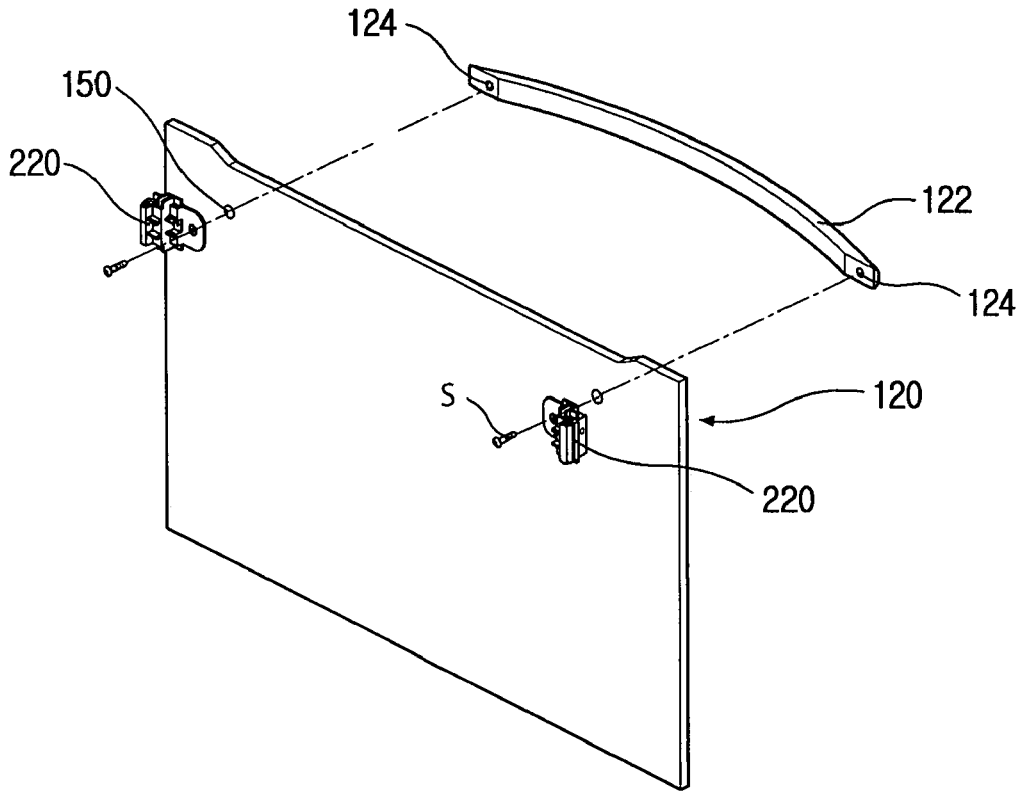
FIG. 4 is an exploded perspective view illustrating a front glass of an oven door.

The door handle 122 is coupled to an upper portion of a front surface of the front glass 120. Users hold the door handle 122 to open and close the oven door 100. In this embodiment, the door handle 122 is a bar having a convex curvature. A screw hole 124 is formed in both ends of the door handle 122 for the assembly using screws. Through-holes 150, as illustrated in FIGS. 3 and 4, are formed in an upper portion of the front glass 120. A coupling member such as a screw goes through the through-hole 150, and possibly also a spacer 222 as described below, to couple the handle to the door.

The door frame 200 is formed on both sides of the front glass 120. The door frame 200 includes three portions and has a long cubic shape to make the side appearance of the oven door 100. The door frame 200 includes upper fixtures 220, a middle frame 240, and a lower fixture 260. The upper fixture 220 forms an upper portion of the door frame 200, the middle frame 240 forms a middle portion of the door frame 200, and the lower fixture 260 forms a lower portion of the door frame 200.

The rear glass 180 forms a rear surface of the oven door 100. The rear glass 180 is forms the rear-most portion of the oven door 100 which is in contact with an oven cavity (not shown) in which food is cooked. The rear glass 180 is exposed to relatively high heat. Therefore, the rear glass 180 may be coated or specially treated so as to resist heat. Furthermore, a space contacting the rear glass 180 is completely sealed regardless of a space contacting the front glass 120, and thus increases an insulation effect as much as possible.

Figure 5:
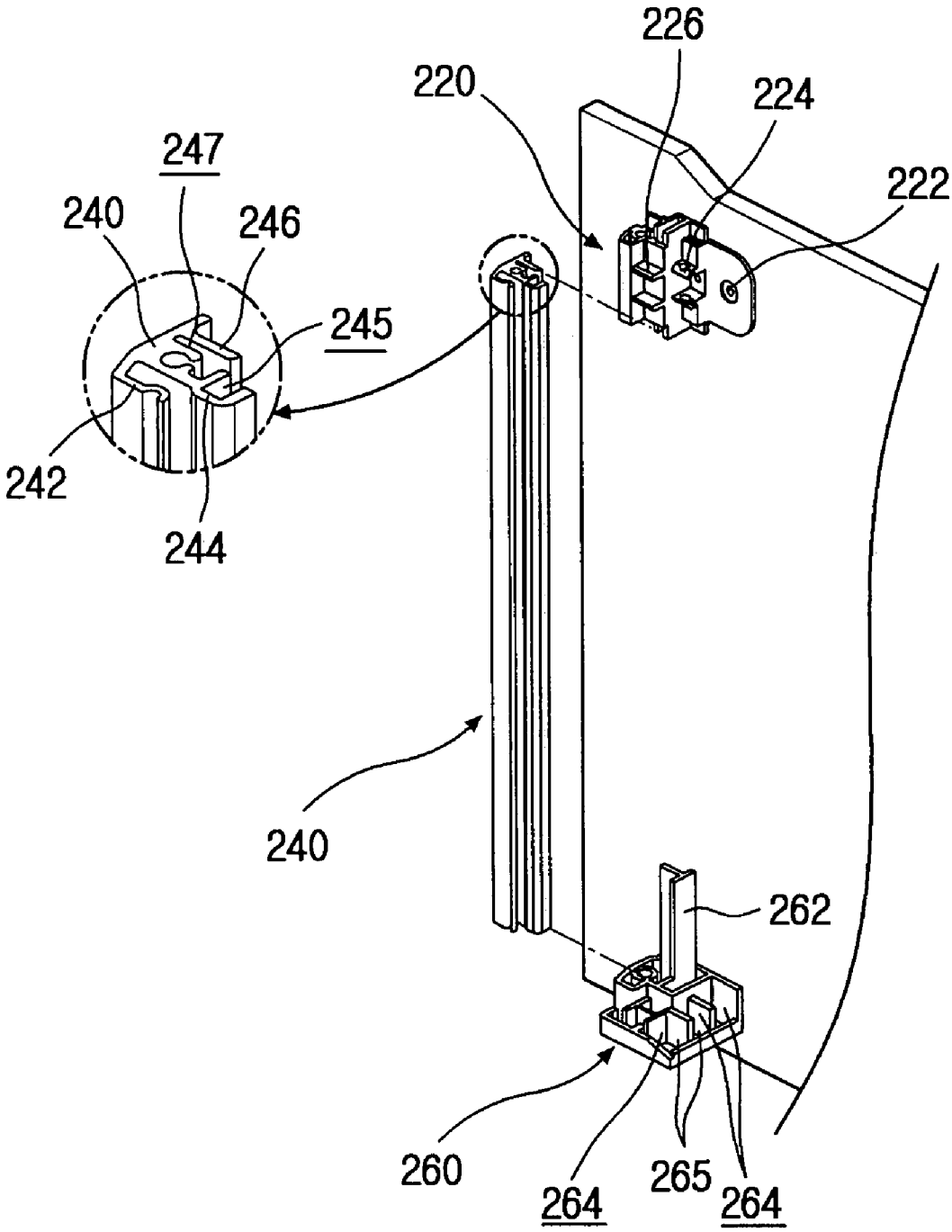
FIG. 5 is an exploded perspective view illustrating a door frame of an oven door.

Referring to FIGS. 3 through 5, the oven door 100 further includes a division member 170, a top shield member 400, and a couple of space-ensuring members 500. The division member 170 is formed between the front glass 120 and the rear glass 180. The top shield member 400 shields a top side of the division members 170. The space-ensuring member 500 detaches the front glass 120 from the division members 170 to prevent damages from impact.

In addition, the division member 170 is formed between the door frames 200. The division member 170 includes a heat-resisting glass 160 and a middle glass 140. The heat-resisting glass 160 is spaced from the rear glass 180 to form a predetermined space therebetween. The middle glass 140 located between the heat-resisting glass 160 and the front glass 120 forms separated spaces between the heat-resisting glass 160 and the front glass 120.

The top shield member 400 is required to have excellent heat insulation performance and excellent strength. For example, the top shield member 400 may be a metal bar. An upper end of the heat-resisting glass 160 of the division member 170 is inserted into the top shield member 400 without an additional coupling member. The top shield member 400 further includes a groove (not shown) having a size corresponding to the thickness of the heat-resisting glass 160.

Figure 8:
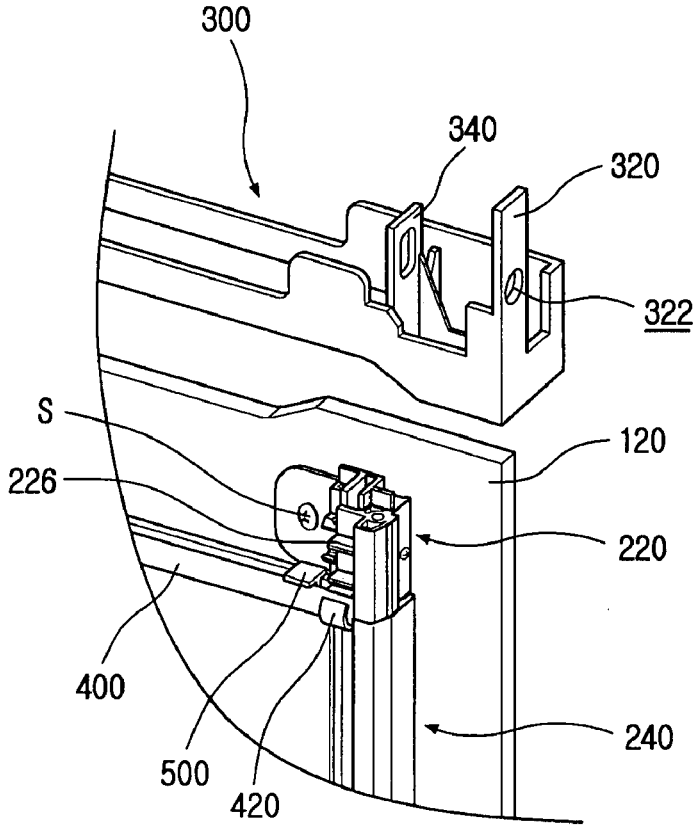
FIG. 8 is a partial perspective view illustrating a top shield member and a middle frame coupled to an upper fixture, and a reversed top cover of an oven door.

In addition, an impact absorption material 420 is formed at both ends of the top shield member 400. FIG. 8, shows how the top shield member 400 is coupled to the heat-resisting glass 160.

The space-ensuring member 500 includes a tetragonal plate and a projection. The tetragonal plate and the projection are formed to be a single element. The projection downwardly protrudes from a middle portion of the tetragonal plate. The couple of space-ensuring members 500 have a shape similar to "T" when viewed from the side. The space-ensuring members 500 are inserted between the middle glass 140 and the heat-resisting glass 160. The space-ensuring members 500 are at left and right portions of the glasses 140 and 160, respectively.

Figure 11:
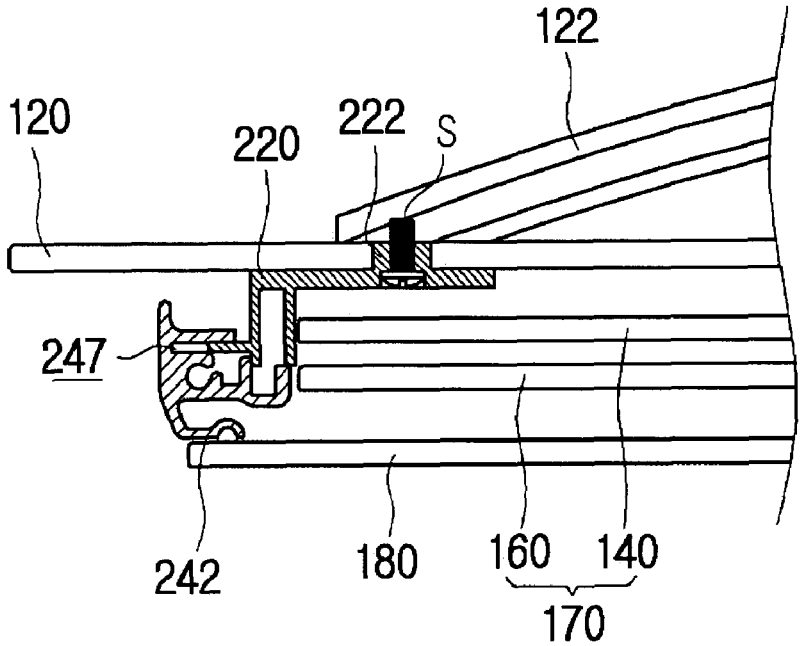
FIG. 11 is a cross sectional view illustrating an upper fixture coupled to a middle frame of an oven door.

The upper fixtures 220 are fixed to the upper portion of the rear surface of the front glass 120 using a coupling member such as a sealant and a screw. As shown in FIG. 11, the spacers 222 are formed on a portion of the upper fixture 220 contacting the front glass 120. The spacer 222 prevents the front glass 120 from being damaged by impact when the front glass 120 is coupled to the door handle 122 by a coupling member such as a screw. The spacer 222 and the upper fixture 220 can be a single element.

Figure 6:
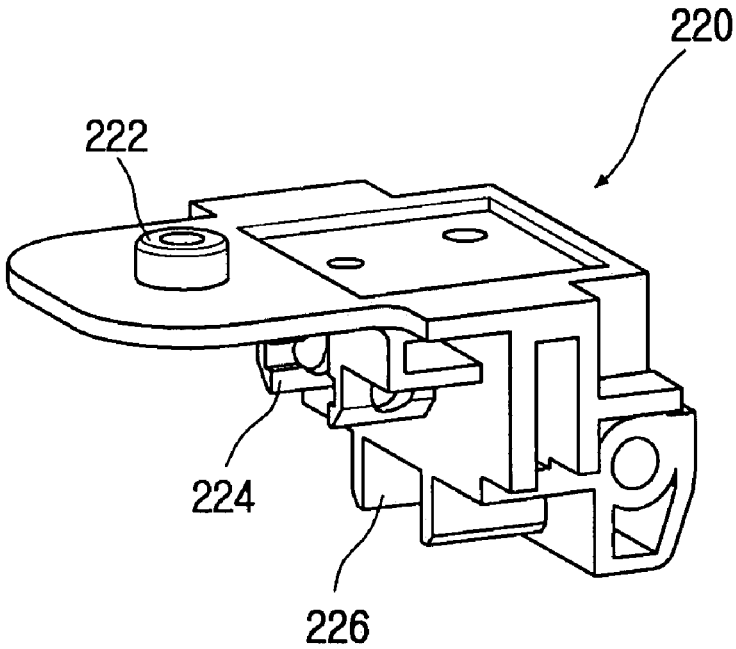
FIG. 6 is a perspective view illustrating an upper fixture of an oven door.
Figure 7:
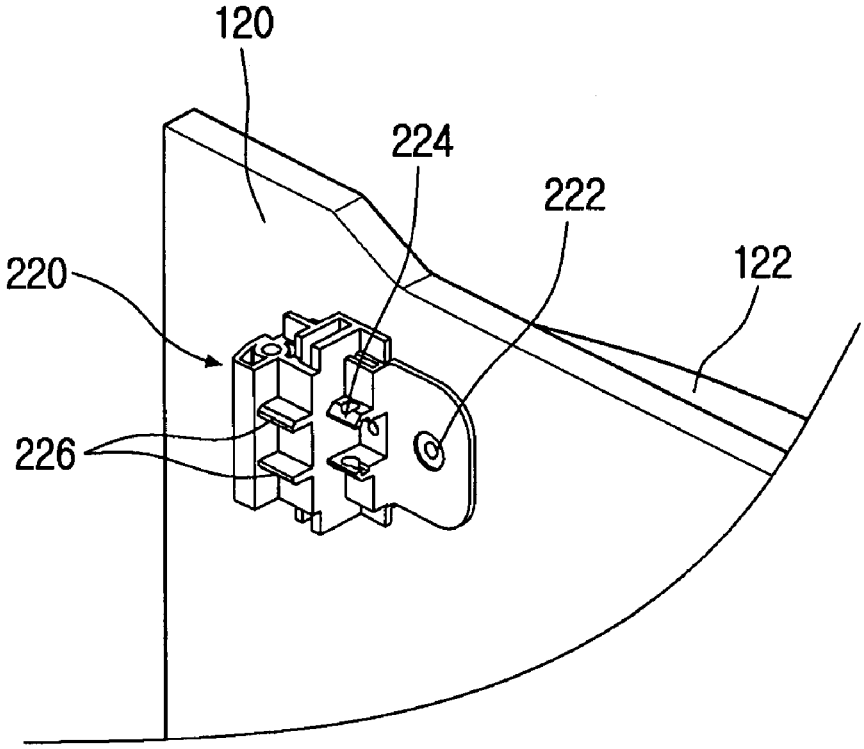
FIG. 7 is a partial perspective view illustrating an upper fixture coupled to a front glass of an oven door.

FIG. 6 is a perspective view illustrating the upper fixture 220 of the oven door 100. FIG. 7 is a perspective view illustrating the upper fixture 220 coupled to the front glass 120 of the oven door 100. FIG. 7 illustrates the upper fixture 220 formed on a right side of the oven door 100 (when viewed from the front). The upper fixture 220 formed at the left side of the oven door 100 has the same shape and is coupled in the same way.

The spacer 222 is formed on the portion of the upper fixture 220 contacting the front glass 120. A stopper 224 and a guide projection 226 are formed behind the spacer 222, that is, toward the rear glass 180. As described above, the spacer 222 is inserted into the through-hole 150, as illustrated in FIG. 4. The spacer 222 has a short tube shape. Referring to FIG. 6, the spacer 222 upwardly protrudes from a top surface of the upper fixture 220. The top surface contacts the front glass 120. The stopper 224 downwardly protrudes from a bottom surface of the upper fixture 220, that is, a side opposite the top surface.

The stopper 224 restricts the assembly position of the space-ensuring member 500, as described below. The stopper 224 contacts a right surface of the space-ensuring member 500 to prevent the space-ensuring member 500 from being pushed out toward the right.

The guide projection 226 is formed on a side of the stopper 224. Referring to FIG. 6, the guide projection 226 downwardly protrudes more than two times the distance that the stopper 224 does. The guide projection 226 restricts the position of the top shield member 400 described below. The guide projection 226 contacts the end of a top surface of the top shield member 400 to prevent the top shield member 400 from being upwardly released.

The upper fixture 220 is attached by applying silicon to a top surface of the left bending portion of the upper fixture 220, that is, the surface from which the spacer 222 protrudes, and then by inserting the spacer 222 into the through-hole 150 in the front glass 120. The door handle 122 is attached to the front glass 120 by putting the door handle 122 on the spacer inserted into the through-hole 150, and then by assembling the door handle 122 using a coupling member such as a screw "s".

FIG. 8 is a partial perspective view illustrating the top shield member 400 and the middle frame 240 coupled to the upper fixture 220. In this figure, top cover 300 of the oven door 100 is shown upside down over the door. The top cover 300 has a length corresponding to the distance between the upper fixtures 220 formed at the left and right portions of the front glass 120. A plurality of projections protrude from both sides of the top cover 300. The projections include a coupling portion 320 and a guide portion 340. The coupling portion 320 is coupled to the upper fixture 220 by a screw. The guide portion 340 protrudes at a predetermined distance from the coupling portion 320. A through-hole 322 is further formed in the coupling portion 320. The guide portion 340 has a length that is approximately half the length of the coupling portion 320. The guide portion 340 contacts an upper portion of the space-ensuring members 500 when assembled.

The top shield member 400 is fitted to an upper end of the heat-resisting glass 160. Both ends of the top shield member 400 contact the guide projections 226 of the upper fixtures 220. An upper end of the top shield member 400 contacts a bottom surface of the space-ensuring member 500.

Figure 9:
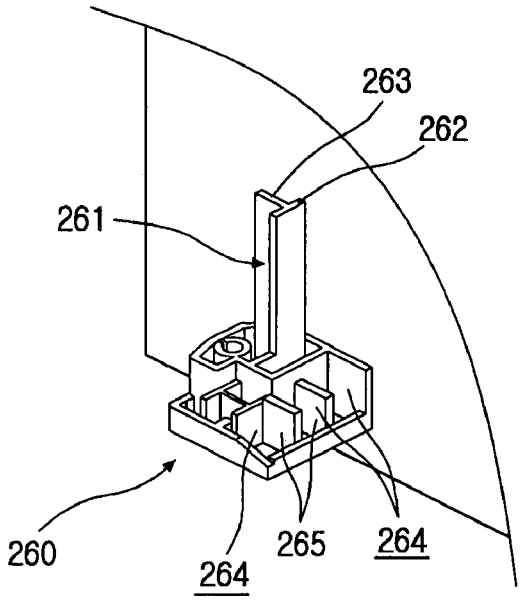
FIG. 9 is a partial perspective view illustrating a lower fixture coupled to a front glass of an oven door.

The lower fixtures 260 are fixed to lower sides ends of the front glass 120. FIG. 9 is a partial perspective view illustrating a lower fixture 260 coupled to the front glass 120 of the oven door 100. Referring to FIG. 9, a bottom surface of the lower fixture 260 is approximately flat. A large projection and a plurality of small projections upwardly protrude from the bottom surface.

A fixing projection 261 and two guide projections 265 are formed on the bottom surface of the lower fixture 260. The fixing projection 261 protruding highest is coupled to the middle frame 240. The guide projections 265 protrude approximately one-tenth the length of the fixing projection 261.

The fixing projection 261 has a shape similar to "□" when viewed from above. A rear projection 262 vertically protrudes from the lower fixture 260, with a side projection 263 horizontally protruding from a middle portion of the rear projection 262. The rear projection 262 and the side projection 263 are formed as a single element. The fixing projection 261 is inserted into a rear insert groove 245 and a side insert groove 247, so that the middle frame 240 and the lower fixture 260 are coupled to each other. The rear and side insert grooves 245 and 247 are formed on the middle frame 240 which will be described below in detail.

The guide projections 265 upwardly protrude a small distance from the fixing projection 261. The two guide projections 265 have the same height and are spaced apart from each other by a distance that is slightly larger than the thickness of the division members 170, that is, the middle glass 140 and the heat-resisting glass 160. This allows the division members 170 to be inserted between the guide projections 265.

A plurality of guide holes 264 are formed in the lower fixture 260 by the guide projections 265. The guide holes 264 are divided by the guide projections 265. The middle glass 140 is inserted into the rear-most space. The heat-resisting glass 160 is inserted in a space formed in front of the middle glass 140. The rear glass 180 is inserted in a space formed in front of the heat-resisting glass 160.

Figure 10:
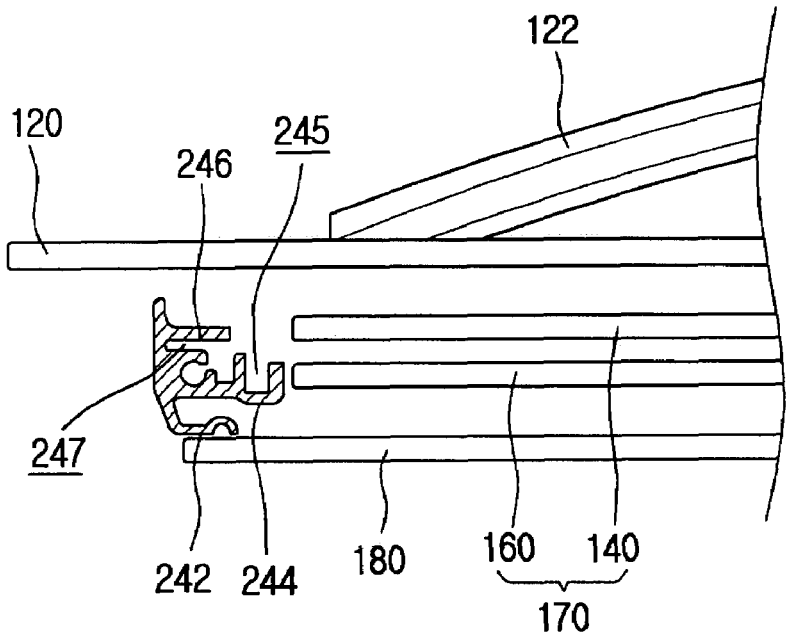
FIG. 10 is a cross sectional view illustrating the disposition of a middle frame, a front glass, a rear glass, and an inside division member of an over door.

FIG. 10 is a cross sectional view illustrating the disposition of the middle frame 240 of the oven door 100. Referring to FIG. 10, the middle frame 240 has a shape similar to "Ⅰ".. The middle frame 240 includes a coupling portion 244, a shield portion 242, and an opening portion 246. The coupling portion 244 is coupled to the rear projection 262 and forms a middle portion of the middle frame 240. The shield portion 242 is extended under the coupling portion 244 and contacts the rear glass 180 to shield a side of a space between the rear glass 180 and the heat-resisting glass 160. The opening portion 246 is extended over the coupling portion 244 and contacts the fixing projection 261.

A right portion of the coupling portion 244 has a shape similar to "U", so that the whole sides are closed except for a top side. Therefore, the right portion of the coupling portion 244 forms the rear insert groove 245 fit to the fixing projection 261 of the lower fixture 260. In addition, a left portion of the coupling portion 244 has a shape similar to "C" and forms a main body of the middle frame 240.

The shield portion 242 is downwardly extended from a bottom surface of the left portion of the coupling portion 244 with a gentle slope, and then is bent to the right. The shield portion 242 has a shape similar to "L". The shield portion 242 contacts the rear glass 180. The shield portion 242 and the coupling portion 244 shield the side of the space between the rear glass 180 and the heat-resisting glass 160 with the coupling portion 244.

The opening portion 246 having a shape similar to "L" is extended over the left portion of the coupling portion 244. In addition, the side insert groove 247 fit to the side projection 263 is formed between the opening portion 246 and the coupling portion 244.

Figure 12:
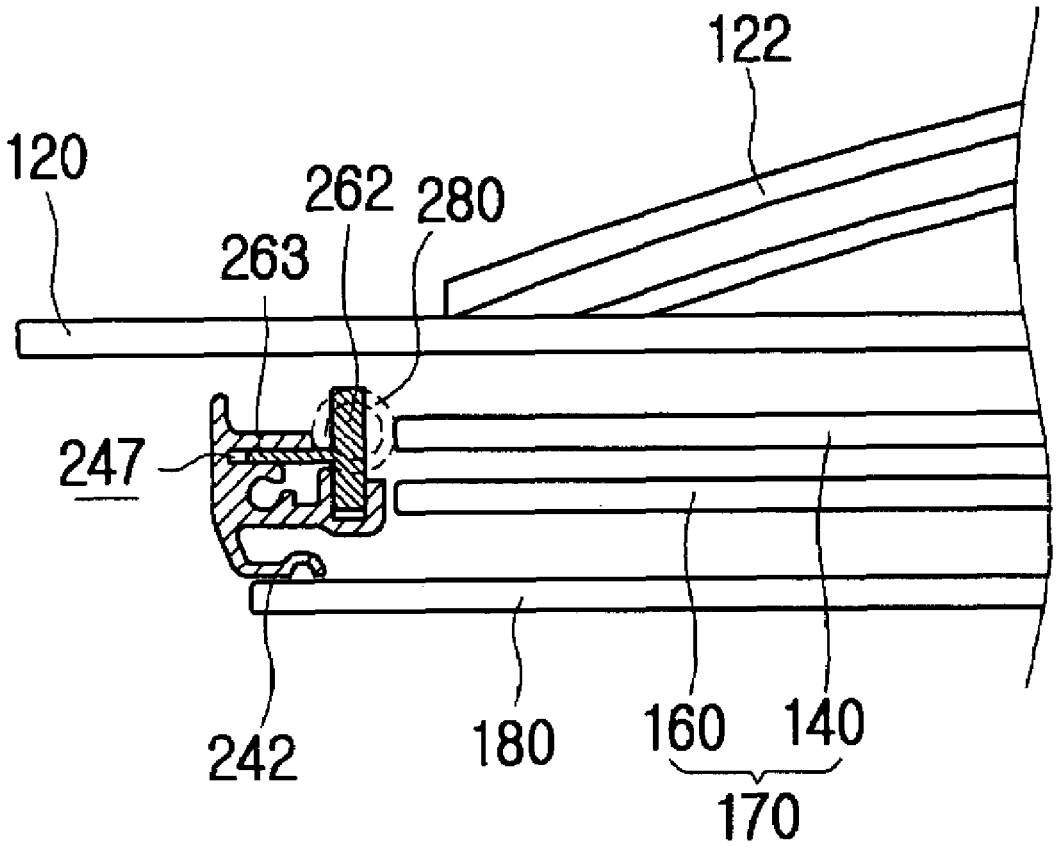
FIG. 12 is a cross sectional view illustrating an assembly of a middle frame, a side-sealing member, and a lower fixture of an oven door.

FIG. 11 is a cross sectional view illustrating the upper fixture 220 coupled to the middle frame 240 according to an embodiment of the present invention, and FIG. 12 is a cross sectional view illustrating an assembly of the middle frame 240, and the rear and side projection 262 and 263 of the lower fixture 260.

Referring to FIG. 12, a side-sealing member 280 illustrated in dotted lines is formed between the middle frame 240 and the middle glass 140. The side-sealing member 280 is a tube formed of an elastic material, which has the same length as the middle frame 240 and is inserted between the middle frame 240 and the middle glass 140.

Referring to FIGS. 10 and 12, the space between the rear glass 180 and the heat-resisting glass 160 and the space between the heat-resisting glass 160 and the middle glass 140 are sealed by the side-sealing member 280 and the middle frame 240. The space between the middle glass 140 and the front glass 120, that is, the side of the space contacting the front glass 120 is not sealed.

The door provides effective insulation of the cooking cavity via the two spaces formed between the rear glass 180, the heat resisting glass 160 and the middle glass 140. Because the sides of the space between the middle glass 140 and the front glass 120 is open, as illustrated in FIG. 12, the front glass 120 and the attached door handle 122 will not become too hot. Referring to FIG. 12, air introduced from the bottom of the oven door 100 to the space contacting the front glass 120 can go out through the side openings when heated. Users can touch the front glass 120 and the door handle 122 contacting the front glass 120 even when the over temperatures are very high.

Hereinafter, functions of the various parts will be described while assembling the oven door 100 with reference to FIGS. 3 and 4.

During assembly of the oven door, the door handle 122 is first attached. Silicon is applied to the top surface of the upper fixture 220, that is, the surface from which the spacer 222 protrudes, so as to attach the door handle 122. After that, the spacer 222 is inserted to the through-hole 150 in the front glass 120 to fix the upper fixture 220 to the front glass 120. The spacer 222 has a height corresponding to the thickness of the front glass 120. The spacer 222 has a diameter slightly smaller than that of the through-hole 150.

After the upper fixture 220 is attached to the rear surface of the front glass 120, the door handle 122 is placed on the front surface of the front glass 120 with the screw hole 124 being aligned with the through-hole 150. The screw "s" goes through the spacer 222 in the front glass 120 rotating in clock wise direction, so that the screw "s" is coupled to the screw hole 124 to couple the door handle 122 to the front glass 120.

The spacer 222 and the upper fixture 220 form a single element to disperse the torque by the screw "s" along the whole upper fixture 220. The upper fixture 220 is coupled to the door handle 122 by the screw "s" with the front glass 120 being between the upper fixture 220 and the door handle 122.

After that, the lower fixtures 260 are fixed to the lower ends of the front glass 120. The lower fixtures 260 are attached to the front glass 120 a certain vertical distance from the upper fixture 220, the distance being the length of the middle frame 240. In addition, the lower fixture 260 is strongly fixed to the lower portion of the front glass 120 with silicon being applied to a rear surface of the lower fixture 260. In addition, a screw can be used for stronger attachment.

The middle frame 240 is mounted between the upper and lower fixtures 220 and 260. The middle frame 240 is coupled with the fixing projection 261 formed on the lower fixture 260, the fixing projection 261 being inserted into the rear insert groove 245 of the middle frame without a screw or sealant.

After the upper and lower fixtures 220 and 260 and the middle frame 240 are fixed to the front glass 120, a lower portion of the middle glass 140 is inserted into the guide hole 264 formed in the lower fixture 260. An upper portion of the middle glass 140 is pushed down until the middle glass 140 is parallel with the front glass 120. In addition, the space-ensuring member 500 is inserted between the upper fixture 220 and the shield member 400.

The side-sealing member 280 is inserted between the middle glass 140 and the middle frame 240. The side-sealing member 280 firmly fixes the middle glass 140 and the middle frame 240 as well as seals between the middle glass 140 and the middle frame 240.

The heat-resisting glass 160 is then inserted in the same way as the middle glass 140. The space-ensuring member 500 is located between the middle glass 140 and the heat-resisting glass 160 to form a space between the two panes of glass. The middle glass 140 and the heat-resisting glass 160 are firmly fixed by the space-ensuring member 500. Therefore, the space-ensuring member 500 prevents the middle glass 140 and the heat-resisting glass 160 from being damaged by impact.

After the heat-resisting glass 160 is inserted, the top shield member 400 is fit to the heat-resisting glass 160. The top shield member 400 shields and insulates an upper side of the space between the heat-resisting glass 160 and the rear glass 180. In addition, the impact absorption material 420 formed at the both ends of the top shield member 400 is formed of an elastic material and contacts the guide projection 226 of the upper fixtures 220. When the top shield member 400 is formed of a metal, the impact absorption material 420 prevents the edge of the top shield member 400 from scratching the heat-resisting and middle glasses 160 and 140.

After the top shield member 400 is fit, the rear glass 180 is placed behind the heat-resisting glass 160. In addition, the top cover 300 is located over the rear glass 180 to fix the rear glass 180. The guide portions 340 formed on both ends of the top cover 300 contact the upper portion of the space-ensuring members 500 to fix the space-ensuring members 500. Simultaneously, the guide portion 340 pushes down and fixes the top shield member 400. In addition, the guide portion 340 fixes the middle and heat-resisting glasses 140 and 160 since the space-ensuring members 500 and the top shield member 400 are coupled to the middle and heat-resisting glasses 140 and 160. In addition, the coupling portions 320 formed on the ends of the top cover 300 are coupled to the upper fixtures 220 by a screw to finish the assembly of the oven door 100.

The door frame is formed of the various parts. Therefore, if one of the middle frames 240 is damaged, only the damaged part is replaced. Similarly, one can individually replace one of the upper and lower fixtures 220 and 260.

When the oven is being used, air introduced from the bottom of the oven door 100 behind the front glass will be heated by heat conduction. The air will rise and go out through only the sides of the space between the front glass 120 and the middle glass 140. That is, the space between the rear glass 180 and the heat-resisting glass 160 is closed, and the space between the heat resisting glass 160 and the middle glass 140 is closed. In contrast, the space between the front glass 120 and the middle glass 140 is open. Therefore, the air introduced from the bottom of the oven door 100 goes out through only the side of the space contacting the front glass 120.

Referring to FIG. 3, the parts of the door other than the lower fixtures 260, which are strongly attached to the front glass 120, are not under serious loads. Therefore, the parts other than the lower fixture 260 and the front glass 120 are easily disassembled by unscrewing the screw "s" of the upper fixture 220.

In addition, the middle frame 240 is very close to the rear glass 180 or actually contacts the rear glass 180 and relatively distant from the front glass 120. Therefore, air introduced from outside goes out through the space between the front glass 120 and the middle frame 240 to cool the front glass 120.

As described above, the oven door includes the division members and the rear glass. The division members and the rear glass are easily coupled by the door frame, the space-ensuring member, and the top cover without additional brackets. The shield frame for insulating is formed of a metal so that thermal deformation of the shield frame is reduced.

The spacer that is attached to the front glass may be used without an additional impact absorption washer when the door handle is coupled to the front glass. The spacer and the upper fixture form a single element to disperse the torque applied by the screw. Therefore, the front glass is not damaged, and the work effect for the assembly and the repair is improved. In addition, the problem of missing washers does not happen.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although a number of embodiments have been described, it should be understood that numerous other modifications and embodiments can be devised by those skilled in the art that will fall within the spirit and scope of the principles of this disclosure. More particularly, variations and modifications are possible in the component parts and/or the subject combinations that would still fall within the scope of the disclosure, the drawings and the appended claims. In addition to variations and modifications in the component parts and/or arrangements, alternative uses will also be apparent to those skilled in the art.

What is claimed is:

1. An oven door, comprising:

a front glass that defines an exterior side of the oven door;

a rear glass that defines an interior side of the oven door;

a plurality of division members arranged at predetermined intervals between the front glass and the rear glass;

first and second middle frame members provided at opposite lateral sides of the plurality of division members, wherein each of the first and second middle frame members is spaced apart from the front glass and encloses a respective one of the lateral sides of the plurality of division members and the rear glass;

first and second lower fixtures attached to lower left and right sides, respectively, of the front glass, wherein the first and second lower fixtures hold and support the division members and the rear glass and wherein each of the first and second lower fixtures includes:

a first projection having a first extension coupled to a first groove in a respective one of the middle frame members and a second extension coupled to a second groove in a respective one of the middle frame members, and a plurality of second projections that define slots for receiving the division members and rear glass respectively, wherein the first projection is at least substantially parallel to the second projections; and a top cover that extends across a top of the front and rear glasses and the plurality of division members.

2. The oven door of claim 1, wherein the top cover completely surrounds upper surface portions of the front and rear glasses and side end portions of the upper surface portions.

3. The oven door of claim 1, wherein the first and second lower fixtures completely surround lower side end portions of rear glass and the division members.

4. The oven door of claim 1, further comprising side-sealing members inserted between one of the division members and the middle frame.

5. The oven door of claim 1, further comprising:

first and second upper fixtures attached to upper left and right sides of the front glass, wherein the first and second upper fixtures operate to maintain a separation distance between the division members; and a door handle coupled to the first and second upper fixtures by fasteners that pass through the front glass.

6. The oven door of claim 5, further comprising:

a top shield member coupled to the first and second upper fixtures, wherein the top shield member seals top edges of the division members; and a space-ensuring member that maintains a separation distance between the division members.

7. The oven door of claim 5, wherein the first and second upper fixtures further comprise spacers that go through the front glass and that contact the door handle.

8. The oven door of claim 7, wherein the spacers have a tube shape with a height equal to or larger than a thickness of the front glass, the spacers having a diameter that increases when pressed in a longitudinal direction.

9. The oven door of claim 5, wherein one of the door handle or the first or second upper fixtures has an area contacting the front glass, the area being significantly larger than an area of the front glass through which the fasteners pass.

10. The oven door of claim 5, wherein each of the first and second upper fixtures includes a third extension is aligned with and coupled to the first groove and a fourth extension or surface is aligned with and coupled to the second groove.

11. The oven door of claim 10, wherein the third and fourth extensions are different portions of a T-shaped section.

12. The oven door of claim 5, wherein each of the first and second upper fixtures includes:

a stopper to set a position of a space-ensuring member that maintains a predetermined separation distance between the division members; and at least one guide projection to set a position of a top shield coupled to the first and second upper fixtures.

13. The oven door of claim 12, wherein:

the at least one guide projection is adjacent and coupled to the stopper, and the stopper projects a first predetermined distance from the front glass and the at least one guide projection projects a second predetermined distance from the front glass, the second predetermined distance greater than the first predetermined distance.

14. The oven door of claim 13, wherein the top shield is below and in contact with the at least one guide projection and the space-ensuring member is located on a side of the at least one guide projection.

15. The oven door of claim 1, wherein the first projection extends from a first surface and the second projections extend from a second surface, and wherein the second surface is lower than the first surface so that each of the first and second lower fixtures support lower edges of the division members and rear glass at a position below the first surface from which the first projection extends.

16. The oven door of claim 1, wherein the first projection is a predetermined number of times longer than each of the second projections.

17. The oven door of claim 16, wherein the first projection is at least 5 times longer than each of the second projections.

18. The oven door of claim 17, wherein the first projection is approximately 10 times longer than each of the second projections.

19. The oven door of claim 1, wherein the first extension is oriented at a predetermined angle relative to the second extension.

20. The oven door of claim 19, wherein the predetermined angle is at least substantially 90°.

21. The oven door of claim 20, wherein the first projection has substantially a T-shaped cross-section, the first and second extensions corresponding to different portions of the T-shaped cross-section.

22. The oven door of claim 1, wherein each of the middle frame members includes a shield member that contacts a surface of the rear glass, the shield member projecting a predetermined distance so that the rear glass is located at a position aligned with a corresponding one of the slots defined by the second projections.

23. The oven door of claim 22, wherein the shield member has a surface that is at least substantially parallel to and in contact with a surface of the rear glass.

24. The oven door of claim 22, wherein the shield member projects at least substantially parallel to one of the first or second grooves.

25. The oven door of claim 1, wherein the first groove is aligned at a position between the division members and the second groove is aligned with a second one of the division members adjacent the rear glass.

26. The oven door of claim 1, wherein the second extension forms at least part of a surface that seals a space between the division members.

27. The oven door of claim 26, wherein surfaces of the first and second lower fixtures seal a space between one of the division members and the rear glass.

28. The oven door of claim 26, wherein a space between one of the division members and the front glass is not sealed.

29. An oven door, comprising:

a front glass;

a door frame coupled to a rear side of the front glass, the door frame having lateral sides that are spaced apart from the rear side of the front glass;

at least one division member attached to the door frame, wherein side edges of the at least one division member are coupled to the lateral sides of the door frame;

a rear glass;

a top cover that covers upper portions of the front glass and the at least one division member;

an air introduction passage formed at a lower portion of the door such that external air can be introduced into a space formed between the front glass and the at least one division member;

an air outlet formed between the front glass and the door frame such that air can be emitted from the space formed between the front glass and the at least one division member wherein a space between the at least one division member and the rear glass is sealed and the space between the front glass and the at least one division member is unsealed to allow heat to pass from the at least one division member to the air outlet, and wherein the air outlet is located along one or more of the lateral sides of the door frame to prevent the heat from flowing towards a handle of the oven door.

30. The oven door of claim 29, wherein the door frame is coupled to the front glass by one of an adhesive material and fasteners, and wherein the at least one division member is supported by the door frame.

31. The oven door of claim 29, wherein the door frame comprises first and second upper fixtures, first and second lower fixtures, and a middle frame.

32. The oven door of claim 31, wherein the first and second upper fixtures and the first and second lower fixtures include projections that couple the fixtures to the middle frame.

33. The oven door of claim 29, further comprising side-sealing members inserted and fixed between the at least one division member and the door frame, wherein the side-sealing members seal side edges of the at least one division member.

34. The oven door of claim 33, further comprising a top shield member that is horizontally fixed at an upper portion of the door frame to seal internal spaces formed, in part, by the at least one division member.

35. The oven door of claim 34, wherein elastic impact absorption material is formed on ends of the top shield member, the elastic impact absorption material contacting the at least one division member and the door frame.

36. The oven door of claim 29, further comprising:

a door handle coupled to the door frame by fasteners that pass through the front glass.

37. An oven, comprising:

a main body having a cooking cavity;

a heat producing element; and a door that closes the cooking cavity, wherein the door comprises:

a heat-resisting glass that shields heat generated in the cooking cavity;

a front glass spaced apart from the heat-resisting glass;

a rear glass spaced apart from the heat-resisting glass;

a lower fixture coupled to a lower rear surface of the front glass, wherein lower end portions of the rear glass and the heat-resisting glass are each received in the lower fixture;

an upper fixture coupled to an upper rear surface of the front glass and vertically aligned with the lower fixture;

a middle frame that extends between the upper and lower fixtures, wherein the middle frame covers side edges of the heat-resisting glass and the rear glass, and wherein the middle frame is spaced from the front glass such that gaps formed between the side edges of the heat resisting glass and the rear glass are covered by the middle frame and a gap formed between the heat shielding glass and the front glass is exposed; and a door handle coupled to the upper fixture, wherein:

the lower fixture includes a first projection having a first extension coupled to a first groove and a second extension coupled to a second groove in the middle frame, and a plurality of second projections that define guide slots for receiving the heat-resisting glass and rear glass, wherein the first projection is at least substantially parallel to the second projections, and the upper fixture includes a third extension aligned with and coupled to the first groove and a fourth extension or surface aligned with and coupled to the second groove.

38. The oven of claim 37, wherein the upper fixture comprises spacers that are inserted into holes in the front glass and which contact the door handle, the spacers having a thickness equal to or larger than that of the front glass and having a diameter that increases when the spacers are pressed in a longitudinal direction.

39. The oven of claim 37, wherein the heat resisting glass comprises:

a first heat resistant glass panel spaced apart at a predetermined interval from the rear glass; and a middle glass panel spaced apart at predetermined intervals between the first heat resistant glass panel and the front glass, wherein the predetermined interval between the first heat resistant glass panel and the middle glass panel is maintained by at least one spacer positioned between top edges thereof.

40. The oven of claim 39, wherein lower end portions of the rear glass, the first heat resistant glass panel and the middle glass panel are received in the guide slots so as to maintain the predetermined intervals therebetween.

41. The oven of claim 37, wherein the door handle is coupled to the upper fixture by fasteners that pass through the front glass.

* * * * *